US011158250B2

(12) United States Patent
Xiao et al.

(10) Patent No.: US 11,158,250 B2
(45) Date of Patent: Oct. 26, 2021

(54) PIXEL COMPENSATION CIRCUIT, METHOD FOR DRIVING THE SAME, DISPLAY PANEL, AND DISPLAY DEVICE

(71) Applicants: BOE Technology Group Co., Ltd., Beijing (CN); Chengdu BOE Optoelectronics Technology Co., Ltd., Chengdu (CN)

(72) Inventors: Yunsheng Xiao, Beijing (CN); Zhenxiao Tong, Beijing (CN); Xiangdan Dong, Beijing (CN); Tingliang Liu, Beijing (CN); Hongwei Ma, Beijing (CN)

(73) Assignees: BOE Technology Group Co., Ltd., Beijing (CN); Chengdu BOE Optoelectronics Technology Co., Ltd., Chengdu (CN)

( * ) Notice: Subject to any disclaimer, the term of this patent is extended or adjusted under 35 U.S.C. 154(b) by 263 days.

(21) Appl. No.: 16/154,950

(22) Filed: Oct. 9, 2018

(65) Prior Publication Data

US 2019/0304364 A1 Oct. 3, 2019

(30) Foreign Application Priority Data

Mar. 27, 2018 (CN) ..... 201810260423.5

(51) Int. Cl.
*G09G 3/3233* (2016.01)

(52) U.S. Cl.
CPC ... *G09G 3/3233* (2013.01); *G09G 2300/0819* (2013.01); *G09G 2320/0204* (2013.01)

(58) Field of Classification Search
CPC ..... G09G 3/3233; G09G 2300/0819; G09G 2320/0204
See application file for complete search history.

(56) References Cited

U.S. PATENT DOCUMENTS

2006/0108937 A1* 5/2006 Kim ..... G09G 3/3233 315/169.3
2009/0108763 A1 4/2009 Han et al.
(Continued)

FOREIGN PATENT DOCUMENTS

CN 102930824 A 2/2013
CN 102956191 A 3/2013
(Continued)

OTHER PUBLICATIONS

SIPO, "First Office Action," issued in connection with Application No. 201810260423.5, dated Jul. 1, 2019, 19 pages.

*Primary Examiner* — Patrick N Edouard
*Assistant Examiner* — Eboni N Giles
(74) *Attorney, Agent, or Firm* — Arent Fox LLP; Michael Fainberg

(57) ABSTRACT

The disclosure discloses a pixel compensation circuit, a method for driving the same, a display panel, and a display device. The pixel compensation circuit includes: a first initialization sub-circuit, a second initialization sub-circuit, an IR drop control sub-circuit, a data writing sub-circuit, a compensation sub-circuit, a driver sub-circuit, a light-emission control sub-circuit, and a light emitting element. The compensation sub-circuit compensates for threshold voltage of the driver sub-circuit, and the IR drop control sub-circuit decreases the influence of the IR drop of a signal of the high-level power supply terminal to the operating current of the light emitting element.

20 Claims, 13 Drawing Sheets

(56) References Cited

U.S. PATENT DOCUMENTS

| | | | | |
|---|---|---|---|---|
| 2013/0043796 | A1 | 2/2013 | Ko et al. | |
| 2014/0192038 | A1 | 7/2014 | Qin et al. | |
| 2016/0104427 | A1* | 4/2016 | Matsueda | G09G 3/3233 345/212 |
| 2016/0372030 | A1 | 12/2016 | Nagayama et al. | |
| 2017/0270860 | A1* | 9/2017 | Wang | G09G 3/3233 |
| 2018/0005575 | A1* | 1/2018 | Lee | G09G 3/3225 |
| 2019/0114960 | A1 | 4/2019 | Lee et al. | |
| 2019/0189057 | A1* | 6/2019 | Dong | G09G 3/3233 |

FOREIGN PATENT DOCUMENTS

| | | | |
|---|---|---|---|
| CN | 103077680 | A | 5/2013 |
| CN | 204288766 | U | 4/2015 |
| CN | 205282057 | U | 6/2016 |
| CN | 107103879 | A | 8/2017 |
| CN | 107507567 | A | 12/2017 |

* cited by examiner

PIXEL COMPENSATION CIRCUIT, METHOD FOR DRIVING THE SAME, DISPLAY PANEL, AND DISPLAY DEVICE

CROSS-REFERENCES TO RELATED APPLICATIONS

This application claims priority to Chinese patent application No. 201810260423.5 filed on Mar. 27, 2018, which is incorporated herein by reference in its entirety.

FIELD

The present disclosure relates to the field of display technologies, and particularly to a pixel compensation circuit, a method for driving the same, a display panel, and a display device.

BACKGROUND

With the popularization of the Internet, and the continuous development of the display technologies, a display panel with a high quality has become an important feature of numerous electronic consumer products. Compared with a Liquid Crystal Display (LCD) panel, an Organic Light-Emitting Diode (OLED) display panel has the advantages of self-luminous, lower power consumption, a lower production cost, a wider angle of view, higher contrast, a higher response speed, more realistic color rendering, being easier to be made light-weighted, thinned, and flexible, etc. At present, the OLED display panel has come to take the place of the traditional PCD panel in the display fields of mobile phones, digital cameras, computers, personal digital assistants, etc., and is expected to become a predominant option of the next generation of display panels.

SUMMARY

In an aspect, an embodiment of the disclosure provides a pixel compensation circuit. The pixel compensation circuit includes a first initialization sub-circuit, a second initialization sub-circuit, an IR drop control sub-circuit, a data writing sub-circuit, a compensation sub-circuit, a driver sub-circuit, a light-emission control sub-circuit, and a light emitting element, wherein the IR drop control sub-circuit is connected respectively with a first node, a second node, and a high-level power supply terminal, and configured to decrease an influence of an IR drop of a signal of the high-level power supply terminal to an operating current of the light emitting element; the compensation sub-circuit is connected respectively with a reset signal terminal, the first node, and the third node, and configured to write a threshold voltage of the driver sub-circuit and the signal of the high-level power supply terminal into the first node under the control of the reset signal terminal; the light-emission control sub-circuit is connected respectively with a light-emission control signal terminal, a third node and a fourth node, and the first initialization sub-circuit is connected respectively with the reset signal terminal, an initialization signal terminal, and the fourth node; and the first initialization sub-circuit is configured, under the control of the reset signal terminal, to write a signal of the initialization signal terminal into the first node through the turned-on light-emission control sub-circuit and the compensation sub-circuit; the second initialization sub-circuit is connected respectively with the reset signal terminal, the high-level power supply terminal, and the second node, and configured to write the signal of the high-level power supply terminal into the second node under the control of the reset signal terminal; the data writing sub-circuit is connected respectively with a scan signal terminal, a data signal terminal, and the second node, and configured to write a signal of the data signal terminal into the second node under the control of the scan signal terminal; and the driver sub-circuit is connected respectively with the first node, the high-level power supply terminal, and the third node; the light emitting element has one terminal connected with the fourth node, and the other terminal connected with a low-level power supply terminal; and the driver sub-circuit is configured, under the control of the first node, to drive the light emitting element to emit light through the turned-on light-emission control sub-circuit.

In a possible implementation, in the pixel compensation circuit above according to the embodiment of the disclosure, the IR drop control sub-circuit includes: a first capacitor and a second capacitor, wherein the first capacitor has one terminal connected with the first node, and the other terminal connected with the high-level power supply terminal; and the second capacitor has one terminal connected with the first node, and the other terminal connected with the second node.

In a possible implementation, in the pixel compensation circuit above according to the embodiment of the disclosure, the compensation sub-circuit includes a first switch transistor. The first switch transistor has a gate connected with the reset signal terminal, a first electrode connected with the first node, and a second electrode connected with the third node.

In a possible implementation, in the pixel compensation circuit above according to the embodiment of the disclosure, the second initialization sub-circuit includes a second switch transistor. The second switch transistor has a gate connected with the reset signal terminal, a first electrode connected with the high-level power supply terminal, and a second electrode connected with the second node.

In a possible implementation, in the pixel compensation circuit above according to the embodiment of the disclosure, the data writing sub-circuit includes a third switch transistor. The third switch transistor has a gate connected with the scan signal terminal, a first electrode connected with the data signal terminal, and a second electrode connected with the second node.

In a possible implementation, in the pixel compensation circuit above according to the embodiment of the disclosure, the light-emission control sub-circuit includes a fourth switch transistor. The fourth switch transistor has a gate connected with the light-emission control terminal, a first electrode connected with the third node, and a second electrode connected with the fourth node.

In a possible implementation, in the pixel compensation circuit above according to the embodiment of the disclosure, the first initialization sub-circuit includes a fifth switch transistor. The fifth switch transistor has a gate connected with the reset signal terminal, a first electrode connected with the initialization signal terminal, and a second electrode connected with the fourth node.

In a possible implementation, in the pixel compensation circuit above according to the embodiment of the disclosure, the driver sub-circuit includes a driver transistor. The driver transistor has a gate connected with the first node, a first electrode connected with the high-level power supply terminal, and a second electrode connected with the third node.

In a possible implementation, in the pixel compensation circuit above according to the embodiment of the disclosure, the IR drop control sub-circuit includes: a first capacitor and a second capacitor, wherein the first capacitor has one terminal connected with the first node, and the other terminal connected with the high-level power supply terminal; and the second capacitor has one terminal connected with the first node, and the other terminal connected with the second node. The compensation sub-circuit includes a first switch transistor, wherein the first switch transistor has a gate connected with the reset signal terminal, a first electrode connected with the first node, and a second electrode connected with the third node. The second initialization sub-circuit includes a second switch transistor, wherein the second switch transistor has a gate connected with the reset signal terminal, a first electrode connected with the high-level power terminal, and a second electrode connected with the second node. The data writing sub-circuit includes a third switch transistor, and the third switch transistor has a gate connected with the scan signal terminal, a first electrode connected with the data signal terminal, and a second electrode connected with the second node. The light-emission control sub-circuit includes a fourth switch transistor, and the fourth switch transistor has a gate connected with the light-emission control terminal, a first electrode connected with the third node, and a second electrode connected with the fourth node. The first initialization sub-circuit includes a fifth switch transistor, and the fifth switch transistor has a gate connected with the reset signal terminal, a first electrode connected with the initialization signal terminal, and a second electrode connected with the fourth node. The driver sub-circuit includes a driver transistor, and the driver transistor has a gate connected with the first node, a first electrode connected with the high-level power supply terminal, and a second electrode connected with the third node.

In a possible implementation, in the pixel compensation circuit above according to the embodiment of the disclosure, all of the first switch transistor, the second switch transistor, the third switch transistor, the fourth switch transistor, the fifth switch transistor, and the driver transistors are P-type transistors or N-type transistors.

In another aspect, an embodiment of the disclosure further provides a method for driving the pixel compensation circuit above. The method includes: in a first period, enabling the first initialization sub-circuit, the second initialization sub-circuit, and the compensation sub-circuit respectively under the control of the reset signal terminal, and enabling the light-emission control sub-circuit under the control of the light-emission control signal terminal, to enable the signal of the initialization signal terminal to be written into the first node, and the signal of the high-level power supply terminal to be written into the second node; in a second period, enabling the second initialization sub-circuit and the compensation sub-circuit respectively under the control of the reset signal terminal, to enable the signal of the high-level power supply terminal to be written into the second node, and the threshold voltage of the driver sub-circuit and the signal of the high-level power supply terminal to be written into the first node; in a third period, enabling the data writing sub-circuit under the control of the scan signal terminal, to enable the signal of the data writing sub-circuit to be written into the second node, and the IR drop control sub-circuit to decrease a change of the IR drop of the signal of the high-level power supply terminal; and in a fourth period, enabling the light-emission control sub-circuit under the control of the light-emission control signal terminal, to enable the light emitting element to emit light.

In further aspect, an embodiment of the disclosure further provides a display panel including the pixel compensation circuit above. The pixel compensation circuit includes a first initialization sub-circuit, a second initialization sub-circuit, an IR drop control sub-circuit, a data writing sub-circuit, a compensation sub-circuit, a driver sub-circuit, a light-emission control sub-circuit, and a light emitting element, wherein the IR drop control sub-circuit is connected respectively with a first node, a second node, and a high-level power supply terminal, and configured to decrease an influence of an IR drop of a signal of the high-level power supply terminal to an operating current of the light emitting element; the compensation sub-circuit is connected respectively with a reset signal terminal, the first node, and the third node, and configured to write a threshold voltage of the driver sub-circuit and the signal of the high-level power supply terminal into the first node under the control of the reset signal terminal; the light-emission control sub-circuit is connected respectively with a light-emission control signal terminal, a third node and a fourth node, and the first initialization sub-circuit is connected respectively with the reset signal terminal, an initialization signal terminal, and the fourth node; and the first initialization sub-circuit is configured, under the control of the reset signal terminal, to write a signal of the initialization signal terminal into the first node through the turned-on light-emission control sub-circuit and the compensation sub-circuit; the second initialization sub-circuit is connected respectively with the reset signal terminal, the high-level power supply terminal, and the second node, and configured to write the signal of the high-level power supply terminal into the second node under the control of the reset signal terminal; the data writing sub-circuit is connected respectively with a scan signal terminal, a data signal terminal, and the second node, and configured to write a signal of the data signal terminal into the second node under the control of the scan signal terminal; and the driver sub-circuit is connected respectively with the first node, the high-level power supply terminal, and the third node; the light emitting element has one terminal connected with the fourth node, and the other terminal connected with a low-level power supply terminal; and the driver sub-circuit is configured, under the control of the first node, to drive the light emitting element to emit light through the turned-on light-emission control sub-circuit.

In a possible implementation, in the display panel above according to the embodiment of the disclosure, the IR drop control sub-circuit includes: a first capacitor and a second capacitor, wherein the first capacitor has one terminal connected with the first node, and the other terminal connected with the high-level power supply terminal; and the second capacitor has one terminal connected with the first node, and the other terminal connected with the second node.

In a possible implementation, in the display panel above according to the embodiment of the disclosure, the compensation sub-circuit includes a first switch transistor. The first switch transistor has a gate connected with the reset signal terminal, a first electrode connected with the first node, and a second electrode connected with the third node.

In a possible implementation, in the display panel above according to the embodiment of the disclosure, the second initialization sub-circuit includes a second switch transistor. The second switch transistor has a gate connected with the reset signal terminal, a first electrode connected with the high-level power supply terminal, and a second electrode connected with the second node.

In a possible implementation, in the display panel above according to the embodiment of the disclosure, the data writing sub-circuit includes a third switch transistor. The third switch transistor has a gate connected with the scan signal terminal, a first electrode connected with the data signal terminal, and a second electrode connected with the second node.

In a possible implementation, in the display panel above according to the embodiment of the disclosure, the light-emission control sub-circuit includes a fourth switch transistor. The fourth switch transistor has a gate connected with the light-emission control terminal, a first electrode connected with the third node, and a second electrode connected with the fourth node.

In a possible implementation, in the display panel above according to the embodiment of the disclosure, the first initialization sub-circuit includes a fifth switch transistor. The fifth switch transistor has a gate connected with the reset signal terminal, a first electrode connected with the initialization signal terminal, and a second electrode connected with the fourth node.

In a possible implementation, in the display panel above according to the embodiment of the disclosure, the driver sub-circuit includes a driver transistor. The driver transistor has a gate connected with the first node, a first electrode connected with the high-level power supply terminal, and a second electrode connected with the third node.

In further aspect, an embodiment of the disclosure further provides a display device including the display panel above.

DETAILED DESCRIPTION

Implementations of the pixel compensation circuit, the method for driving the same, the display panel, and the display device according to the embodiments of the disclosure will be described below in details with reference to the drawings. It shall be noted that the embodiments described in the specification are only a part but not all of the embodiments of the disclosure, and the embodiments of the disclosure and the features in the embodiments can be combined with each other unless they conflict with each other. Furthermore based upon the embodiments here of the disclosure, all the other embodiments which can occur to those ordinarily skilled in the art without any inventive effort shall fall into the claimed scope of the disclosure.

Unlike the LCD panel of which luminance is controlled using stable voltage, the OLED display panel is current-driven, where pixels are driven using current generated by a driver transistor in a saturated state to emit light. However it is difficult to guarantee uniformity of the threshold voltage of the driver transistor in the process of fabricating the OLED display panel, and the threshold voltage of the driver transistor in operation may drift differently, thus resulting in the problem of non-uniform luminance of the display panel. In order to improve non-uniform luminance of the OLED display panel, it is common in the related to compensate the threshold voltage of the driver transistor using a pixel compensation circuit. Unfortunately the uniformity of luminance of the OLED display panel may be affected by an IR drop across a high-level power supply VDD in the pixel compensation circuit.

Figure 1:
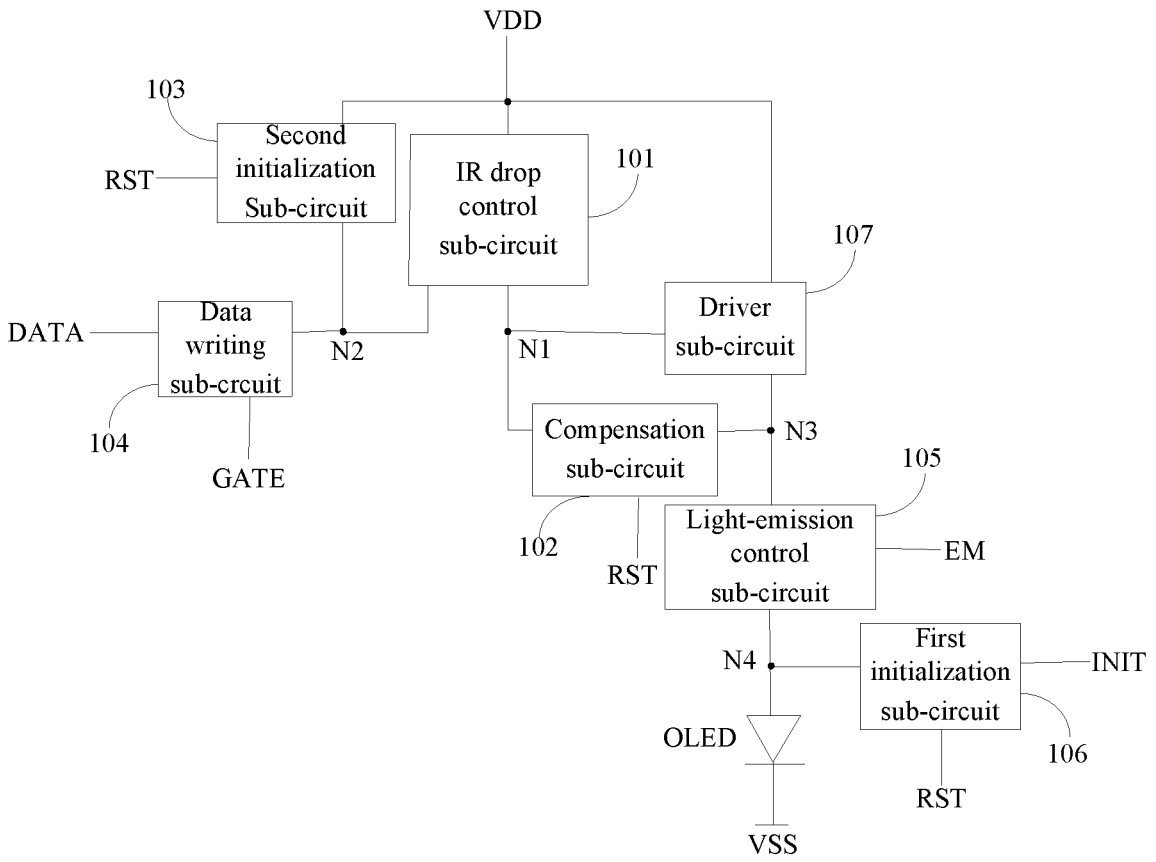
FIG. 1 is a schematic structural diagram of a pixel compensation circuit according to an embodiment of the disclosure.

As illustrated in FIG. 1, a pixel compensation circuit according to an embodiment of the disclosure includes: an IR drop control sub-circuit 101, a compensation sub-circuit 102, a second initialization sub-circuit 103, a data writing sub-circuit 104, a light-emission control sub-circuit 105, a first initialization sub-circuit 106, a driver sub-circuit 107, and a light emitting element OLED.

The IR drop control sub-circuit 101 is connected respectively with a first node N1, a second node N2, and a high-level power supply terminal VDD, and configured to decrease an influence of an IR drop of a signal at the high-level power supply terminal VDD to the operating current of the light emitting element OLED.

The compensation sub-circuit 102 is connected respectively with a reset signal terminal RST, the first node N1, and the third node N3, and configured to write a threshold voltage Vth of the driver sub-circuit 107 and the signal of the high-level power supply terminal VDD into the first node N1 under the control of the reset signal terminal RST.

The light-emission control sub-circuit 105 is connected respectively with a light-emission control signal terminal EM, a third node N3 and a fourth node N4, and the first initialization sub-circuit 106 is connected respectively with the reset signal terminal RST, an initialization signal terminal INIT, and the fourth node N4; and the first initialization sub-circuit 106 is configured to write a signal of the initialization signal terminal INIT into the first node N1 through the turned-on light-emission control sub-circuit 105 and the compensation sub-circuit 102 under the control of the reset signal terminal RST.

The second initialization sub-circuit 103 is connected respectively with the reset signal terminal RST, the high-level power terminal VDD, and the second node N2, and configured to write the signal of the high-level power terminal VDD into the second node N2 under the control of the reset signal terminal RST.

The data writing sub-circuit 104 is connected respectively with a scan signal terminal GATE, a data signal terminal DATA, and the second node N2, and configured to write a signal of the data signal terminal DATA into the second node N2 under the control of the scan signal terminal GATE.

The driver sub-circuit 107 is connected respectively with the first node N1, the high-level power supply terminal VDD, and the third node N3; the light emitting element OLED has one terminal connected with the fourth node N4, and the other terminal connected with a low-level power supply terminal VSS. The driver sub-circuit 107 is configured, under the control of the first node N1, to drive the light emitting element OLED to emit light through the turned-on light-emission control sub-circuit 105.

In the pixel compensation circuit above according to the embodiment of the disclosure, the compensation sub-circuit 102 compensates for the threshold voltage Vth of the driver sub-circuit 107, and the IR drop control sub-circuit 101 decreases an influence of the IR drop of the signal of the high-level power supply terminal VDD on operating current of the light emitting element OLED, so that luminance of the light emitting elements OLED are substantially uniform, thus improving the uniformity of luminance throughout a display panel.

Figure 2:
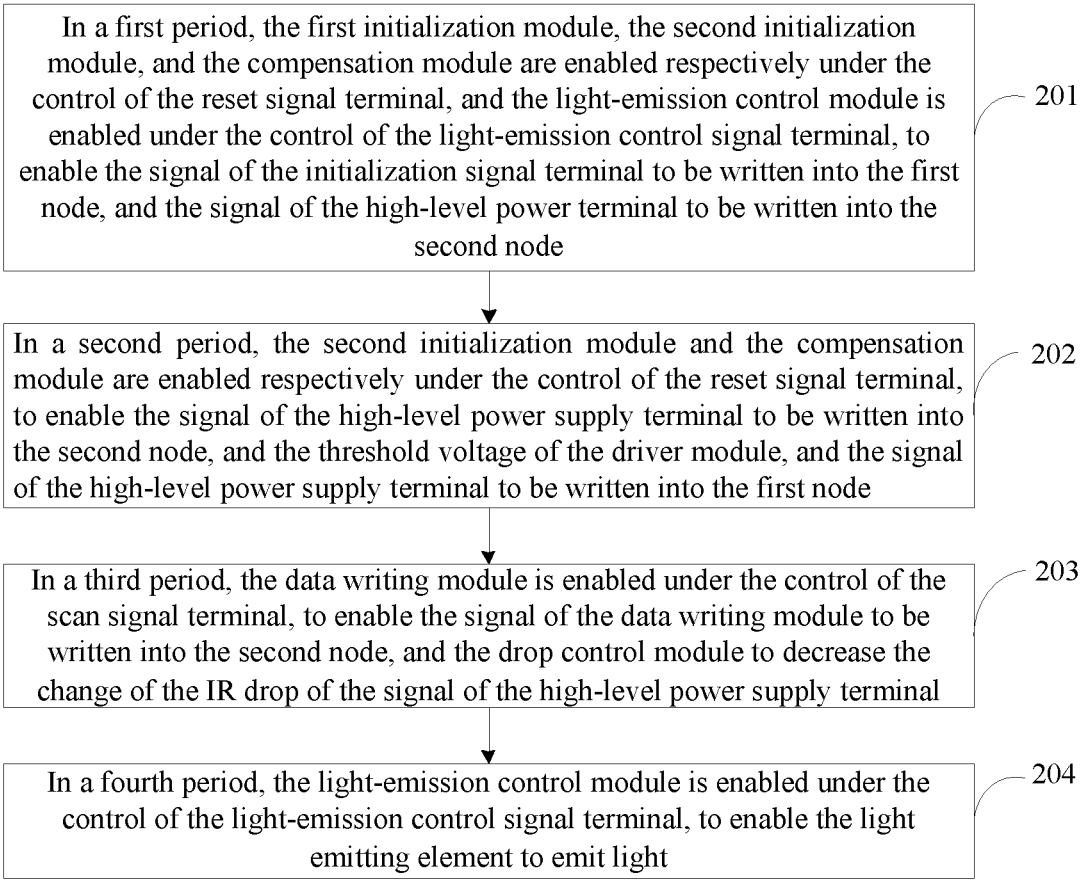
FIG. 2 is a flow chart of a method for driving the pixel compensation circuit as illustrated in FIG. 1.

Correspondingly for the pixel compensation circuit as illustrated in FIG. 1, an embodiment of the disclosure provides a method for driving the same as illustrated in FIG. 2, and the method includes the following steps.

In the step S201, in a first period, the first initialization sub-circuit, the second initialization sub-circuit, and the compensation sub-circuit are enabled respectively under the control of the reset signal terminal, and the light-emission control sub-circuit is enabled under the control of the light-emission control signal terminal, so that the signal of the initialization signal terminal is written into the first node, and the signal of the high-level power terminal is written into the second node.

In the step S202, in a second period, the second initialization sub-circuit and the compensation sub-circuit are enabled respectively under the control of the reset signal terminal, so that the signal of the high-level power supply terminal is written into the second node, and the threshold voltage of the driver sub-circuit and the signal of the high-level power supply terminal are written into the first node.

In the step S203, in a third period, the data writing sub-circuit is enabled under the control of the scan signal terminal, so that the signal of the data signal terminal is written into the second node, and the IR drop control sub-circuit decreases the change of the IR drop of the signal of the high-level power supply terminal.

In the step S204, in a fourth period, the light-emission control sub-circuit is enabled under the control of the light-emission control signal terminal, so that the light emitting element emits light.

In order to better understand the structure and the operating principle of the pixel compensation circuit as illustrated in FIG. 1, two embodiments thereof will be described below in details.

Figure 3:
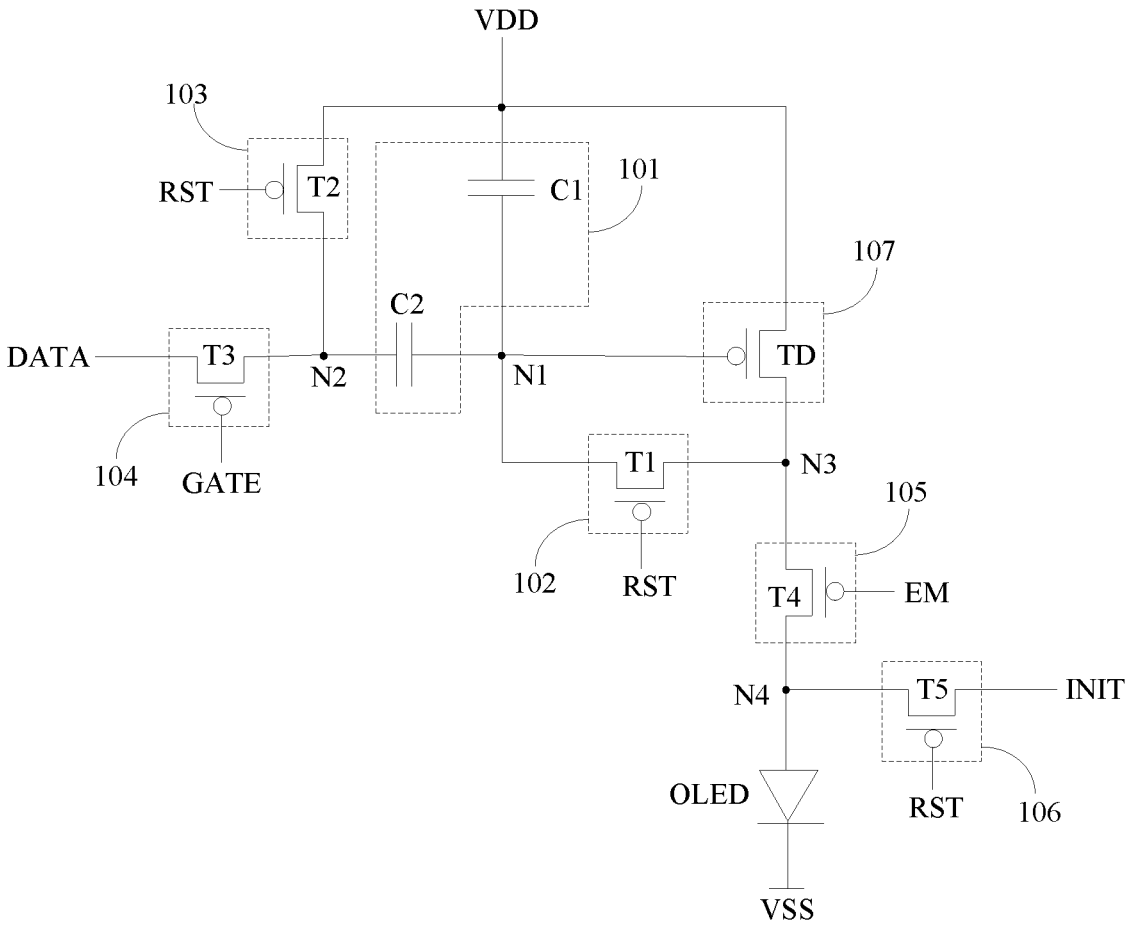
FIG. 3 is a first schematic diagram of a structure of the pixel compensation circuit as illustrated in FIG. 1.

FIG. 3 illustrates a specific embodiment of the pixel compensation circuit as illustrated in FIG. 1. As illustrated in FIG. 3, the IR drop control sub-circuit 101 includes: a first capacitor C1 and a second capacitor C2. The first capacitor C1 has one terminal connected with the first node N1, and the other terminal connected with the high-level power supply terminal VDD; and the second capacitor C2 has one terminal connected with the first node N1, and the other terminal connected with the second node N2.

The compensation sub-circuit 102 includes a first switch transistor T1. The first switch transistor T1 has a gate connected with the reset signal terminal RST, a first electrode connected with the first node N1, and a second electrode connected with the third node N3.

The second initialization sub-circuit 103 includes a second switch transistor T2. The second switch transistor T2 has a gate connected with the reset signal terminal RST, a first electrode connected with the high-level power supply terminal VDD, and a second electrode connected with the second node N2.

The data writing sub-circuit 104 includes a third switch transistor T3. The third switch transistor T3 has a gate connected with the scan signal terminal GATE, a first electrode connected with the data signal terminal DATA, and a second electrode connected with the second node N2.

The light-emission control sub-circuit 105 includes a fourth switch transistor T4. The fourth switch transistor T4 has a gate connected with the light-emission control terminal EM, a first electrode connected with the third node N3, and a second electrode connected with the fourth node N4.

The first initialization sub-circuit 106 includes a fifth switch transistor T5. The fifth switch transistor T5 has a gate connected with the reset signal terminal RST, a first electrode connected with the initialization signal terminal INIT, and a second electrode connected with the fourth node N4.

The driver sub-circuit 107 includes a driver transistor TD. The driver transistor has a gate connected with the first node N1, a first electrode connected with the high-level power supply terminal VDD, and a second electrode connected with the third node N3.

It shall be noted that the structures of the respective sub-circuits in the pixel compensation circuit have been described above only by way of an example, and in fact, the structures of the respective sub-circuits will not be limited to the structures above according to the embodiment of the disclosure, but can alternatively be other structures known to those skilled in the art.

Furthermore the transistors as referred to in the embodiment above can be Thin Film Transistors (TFTs), or can be Metal Oxide Semiconductor Field Effect Transistors (MOSFETs), although the embodiment of this disclosure will not be limited thereto. Furthermore all of these transistors are P-type transistors. The first electrodes and the second electrodes of these transistors are sources and drains respectively, and in a real application, the functions of the first electrodes and the second electrodes can be replaced with each other dependent upon their different transistor types and input signals instead of being distinguished from each other.

Figure 4:
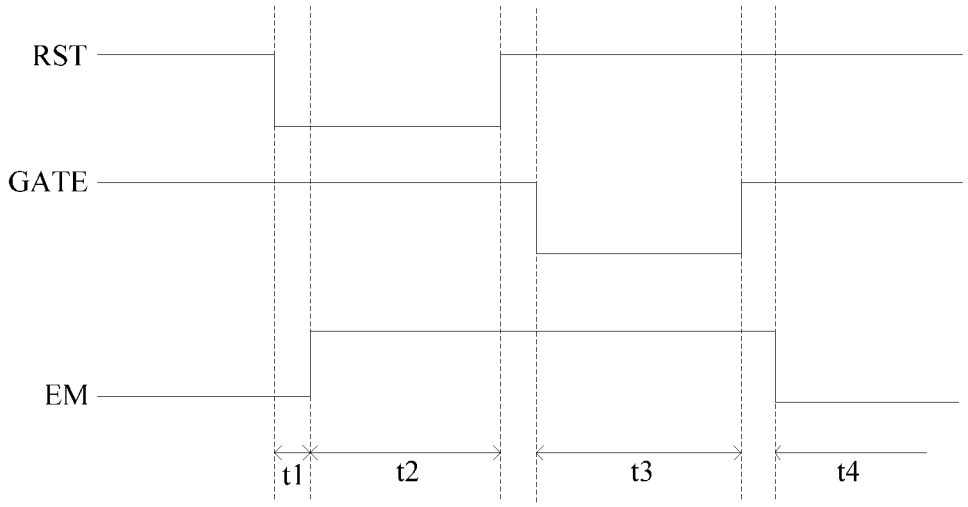
FIG. 4 is an operating timing diagram of the pixel compensation circuit as illustrated in FIG. 3.

The operating process of the pixel compensation circuit as illustrated in FIG. 3 will be described below in details, where the respective P-type transistors are turned on at a low level, and turned off at a high level. FIG. 4 illustrates a corresponding operating timing diagram thereof, and specifically a first period t1, a second period t2, a third period t3, and a fourth period t4 in the operating timing diagram as illustrated in FIG. 4 will be described in details by way of an example. Furthermore it shall be noted that in FIG. 4, the second period t2 and the third period t3 are theoretically consecutive in time, but in a real application, an interval is arranged between the second period t2 and the third period t3 so as to avoid a signal in the second period t2 from interfering with a signal in the third period t3. Alike an interval is arranged between the third period t3 and the fourth period t4 so as to avoid a signal in the third period t3 from interfering with a signal in the fourth period t4.

In the first period t1, the reset signal terminal RST outputs a low level, the scan signal terminal GATE outputs a high level, and the light-emission control signal terminal EM outputs a low level.

Figure 5A:
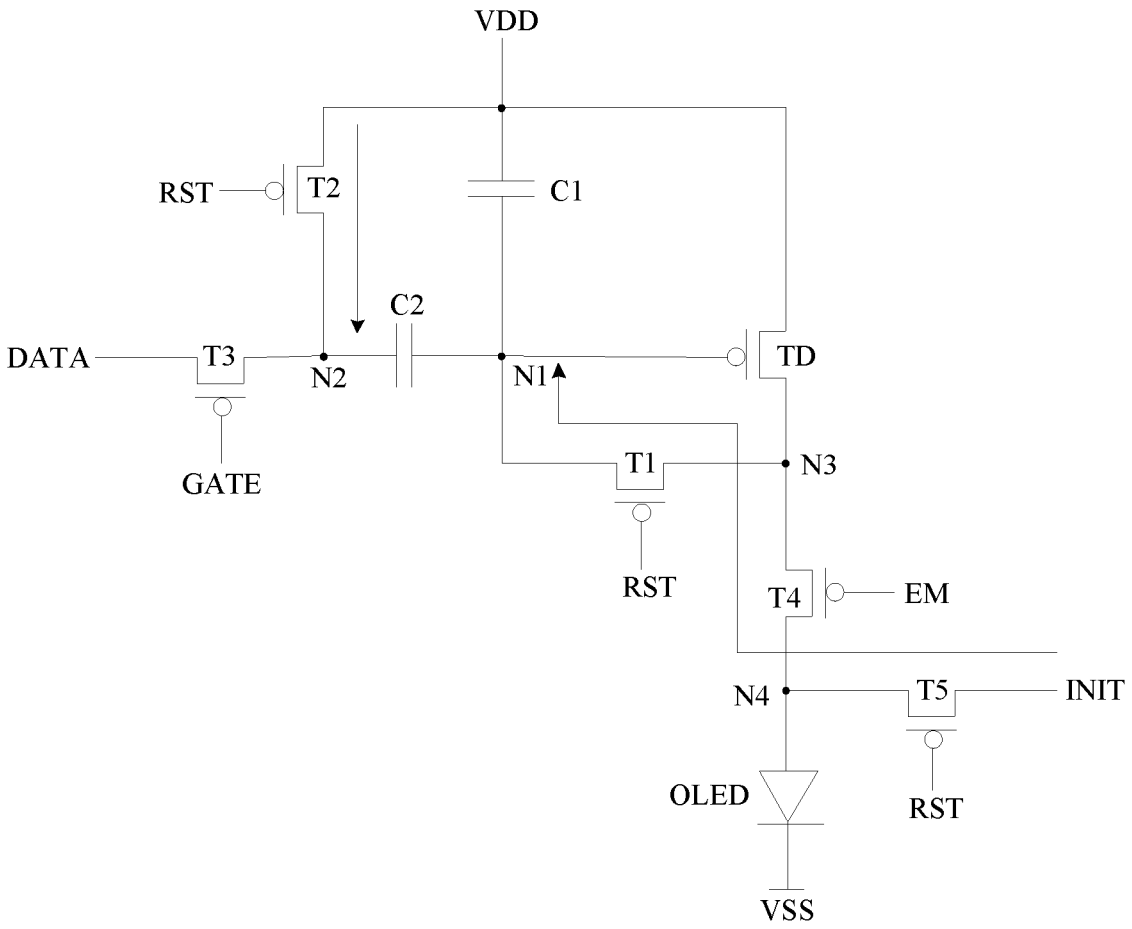
FIG. 5A to FIG. 5D are schematic diagrams of operating states of the pixel compensation circuit as illustrated in FIG. 3 in different periods.

The first switch transistor T1, the second switch transistor T2, and the fifth switch transistor T5 are turned on at the low level of the reset signal terminal RST, the fourth switch transistor T4 is turned on at the low level of the light-emission control signal terminal EM, and the third switch transistor T3 is turned off at the high level of the scan signal terminal GATE. As illustrated in FIG. 5A, a signal Vinit of the initialization signal terminal INIT is written into the first node N1 sequentially through the turned-on fifth switch transistor T5, the turned-on fourth switch transistor T4, the turned-on first switch transistor T1, and stored in the first capacitor C1, where the driver transistor TD is turned off; and a high-level signal Vdd of the high-level power supply terminal VDD is written into the second node N2 through the turned-on second switch transistor T2.

In the second period t2, the reset signal terminal RST outputs a low level, the scan signal terminal GATE outputs a high level, and the light-emission control signal terminal EM outputs a high level.

Figure 5B:
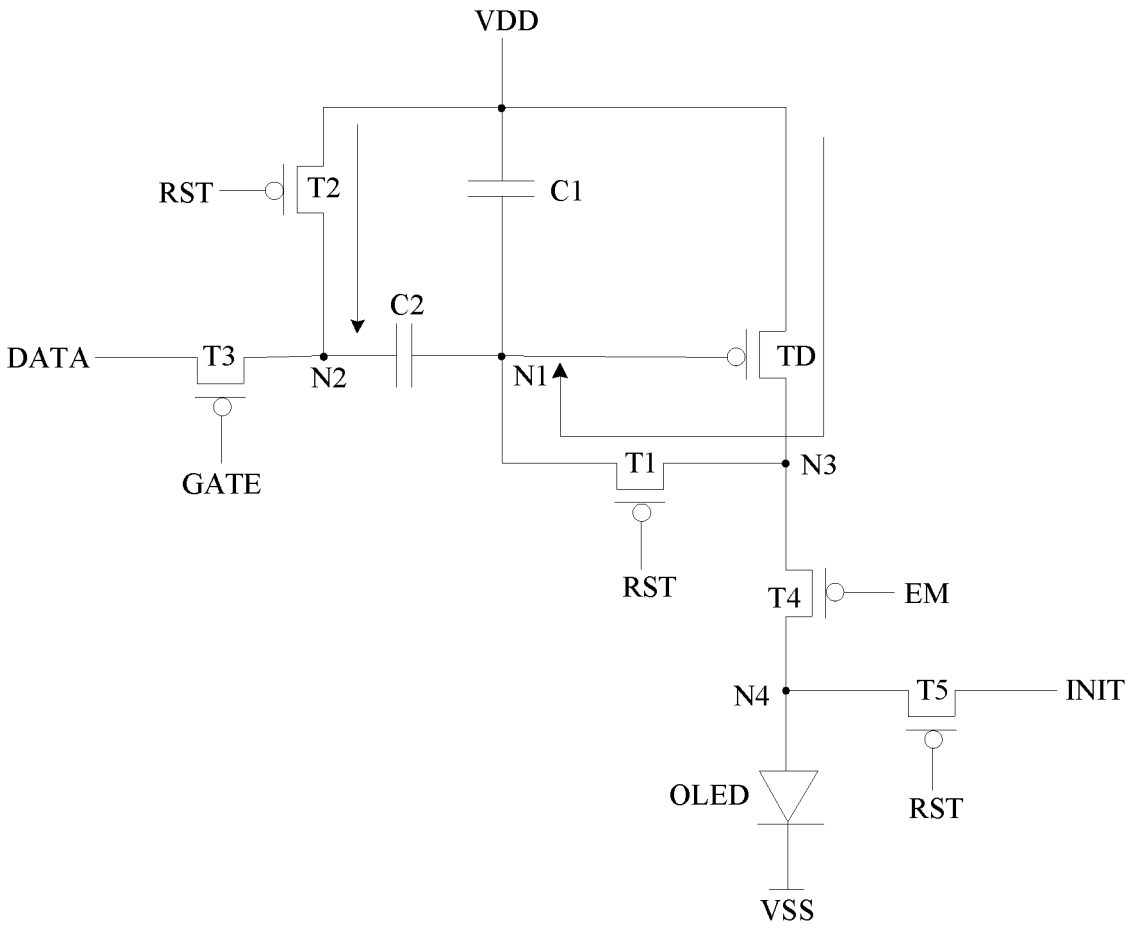

The first switch transistor T1, the second switch transistor T2, and the fifth switch transistor T5 remain turned on at the low level of the reset signal terminal RST, the fourth switch transistor T4 is turned off at the high level of the light-emission control signal terminal EM, and the third switch transistor T3 is turned off at the high level of the scan signal terminal GATE. As illustrated in FIG. 5B, a high-level signal Vdd of the high-level power supply terminal VDD is written into the second node N2 through the turned-on second switch transistor T2, and stored in the second capacitor C2; and at this time, the first capacitor C1 still stores the signal Vinit of the initialization signal terminal INIT input in the first period t1, so that the voltage difference Vgs between the first node N1 (i.e., the gate of the driver transistor TD), and the source of the driver transistor TD is Vinit-Vdd, and Vinit-Vdd<Vth (i.e., the threshold voltage of the driver transistor TD), where Vth is negative, so the driver transistor TD is turned on, and the high-level signal Vdd charges the first capacitor C1 through the driver transistor TD. Since the high-level signal Vdd charges the first capacitor C1 through the driver transistor TD, the resulting voltage of the first node N1 is Vdd+Vth, and this voltage is the voltage of the gate of the driver transistor TD exactly upon being turned off.

In a third period t3, the reset signal terminal RST outputs a high level, the scan signal terminal GATE outputs a low level, and the light-emission control signal terminal EM outputs a high level.

Figure 5C:
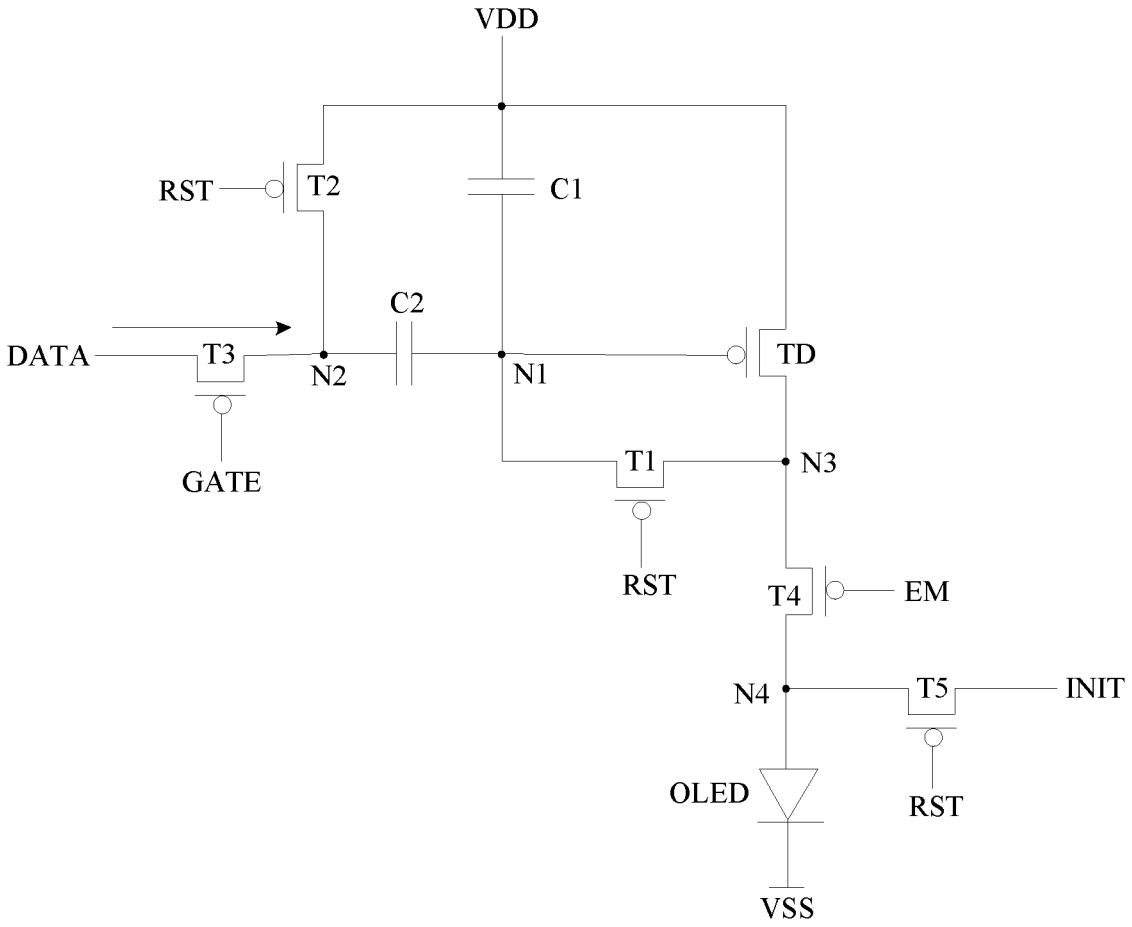

The third switch transistor T3 is turned on at the low level of the scan signal terminal GATE, and the other transistors are turned off respectively at the signals output by their corresponding control terminals. As illustrated in FIG. 5C, the data signal Vdata of the data signal terminal DATA is output to the second node N2 through the turned-on third switch transistor T3. Since the total amount of charges in the first capacitor C1 and the second capacitor C2 remains unchanged, the voltage of the first node N1 is changed to (Vdata−Vdd)*C2/(C1+C2)+Vdd+Vth.

In the fourth period t4, the reset signal terminal RST outputs a high level, the scan signal terminal GATE outputs a high level, and the light-emission control signal terminal EM outputs a low level.

Figure 5D:
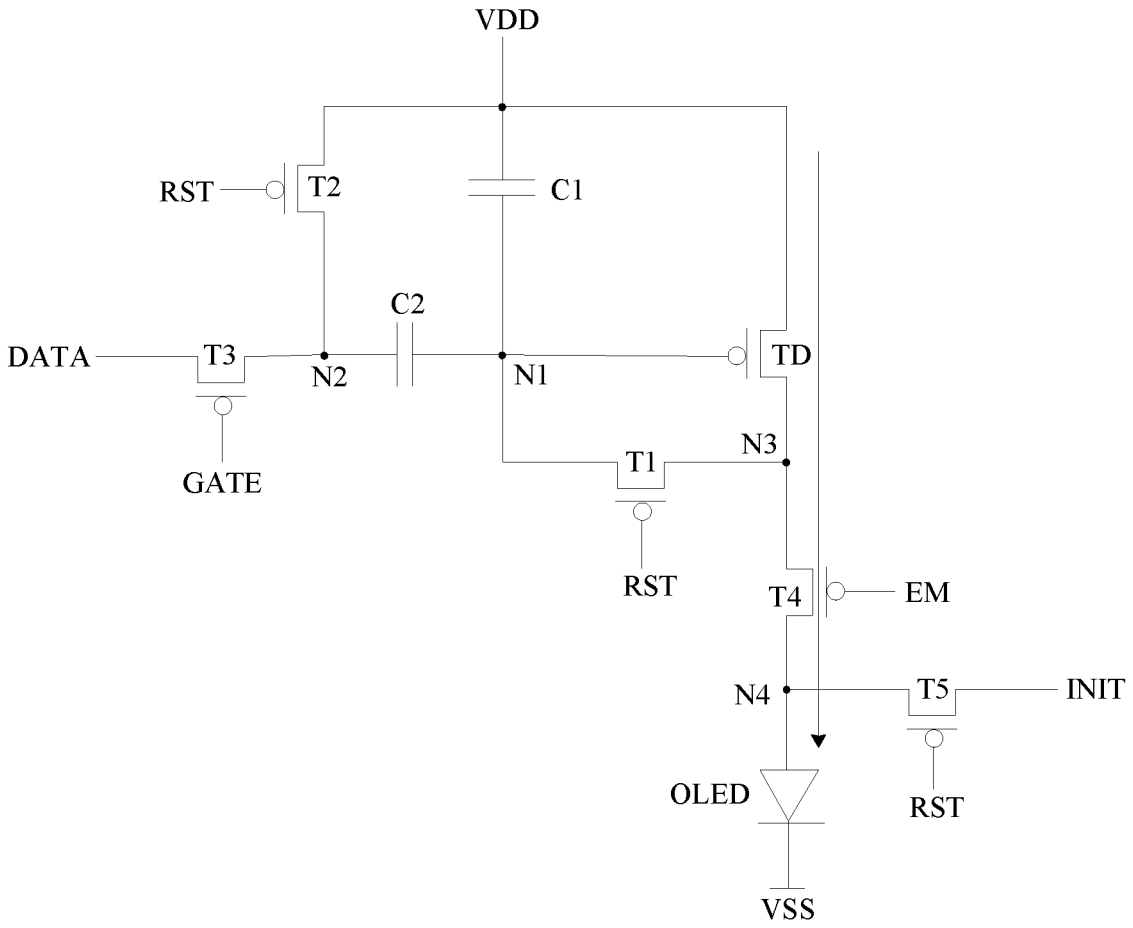

The fourth switch transistor T4 is turned on at the low level of the light-emission control signal terminal EM, and the other transistors are turned off respectively at the signals output by their corresponding control terminals. Since neither the first capacitor C1 nor the second capacitor C2 has a discharging path, the first node N1 maintains the voltage thereof at the end of the third period t3, i.e., (Vdata−Vdd)*C2/(C1+C2)+Vdd+Vth, and at this time, the gate-source voltage difference of the driver transistor TD is Vgs=(Vdata−Vdd)*C2/(C1+C2)+Vdd+Vth, the driver transistor TD is turned on, driving current output by the driver transistor TD is provided to the light-emitting element OLED through the turned-on fourth switch transistor T4, and the light-emitting element OLED is driven by the driving current to emit light, so that an image is displayed in grayscale, as illustrated in FIG. 5D. The operating current $I_{OLED}$ driving the light-emitting element OLED to emit light is current of the driver transistor TD in a saturated state particularly as follows:

$$I_{OLED} = \frac{K}{2}(Vgs - Vth)^2 = \frac{K}{2}\left\{\left[\frac{(Vdata - Vdd)*C2}{C2 + C1} + Vdd + Vth\right] - Vdd - Vth\right\}^2 = \frac{K}{2}\left(Vdata*\frac{C2}{C1 + C2} - Vdd*\frac{C2}{C1 + C2}\right)^2.$$

Where K is a process constant. As can be apparent from the equation above, the operating current $I_{OLED}$ of the driver transistor TD to drive the light-emitting element OLED to emit light is independent of the threshold voltage Vth of the driver transistor TD, so that the operating current of the light-emitting element OLED can be avoided from being affected by the threshold voltage Vth drifting due to a process of fabricating the driver transistor TD, and a long operating time period of the driver transistor TD, to thereby enable the operating current of the light-emitting element OLED to remain stable so as to enable the light-emitting element OLED to emit light normally, thus improving the uniformity of luminance of the display panel to some extent.

In addition, when the high-level power supply terminal VDD provides the high-level signal Vdd for pixel compensation circuits in pixel zones of a display panel, there is such an IR drop that a high-level signal Vdd' received by a pixel compensation circuit farther from the high-level power supply terminal VDD is lower, and specifically Vdd'=Vdd−ΔVdd, where ΔVdd is an IR drop while the high-level signal Vdd is being transmitted to the pixel compensation circuit farther from the high-level power terminal VDD. At this time, the operating current of the light-emitting element OLED in the pixel compensation circuit farther from the high-level power supply terminal VDD is defined in the equation of:

$$I_{OLED} = \frac{K}{2}\left[Vdata*\frac{C2}{C1 + C2} - (Vdd - \Delta Vdd)*\frac{C2}{C1 + C2}\right]^2 = \frac{K}{2}\left[(Vdata - Vdd)*\frac{C2}{C1 + C2} + \Delta Vdd*\frac{C2}{C1 + C2}\right]^2.$$

As can be apparent, when the ratio of the capacitance of the first capacitor C1 to the capacitance of the second capacitor C2 is larger, the value of ΔVdd*C2/(C1+C2) is smaller, so the capacitances of the first capacitor C1 and the second capacitor C2 are set reasonably, to decrease the influence of the IR drop of the high-level signal Vdd output by the high-level power supply terminal VDD to the uniformity of luminance of the display panel.

Figure 6A:
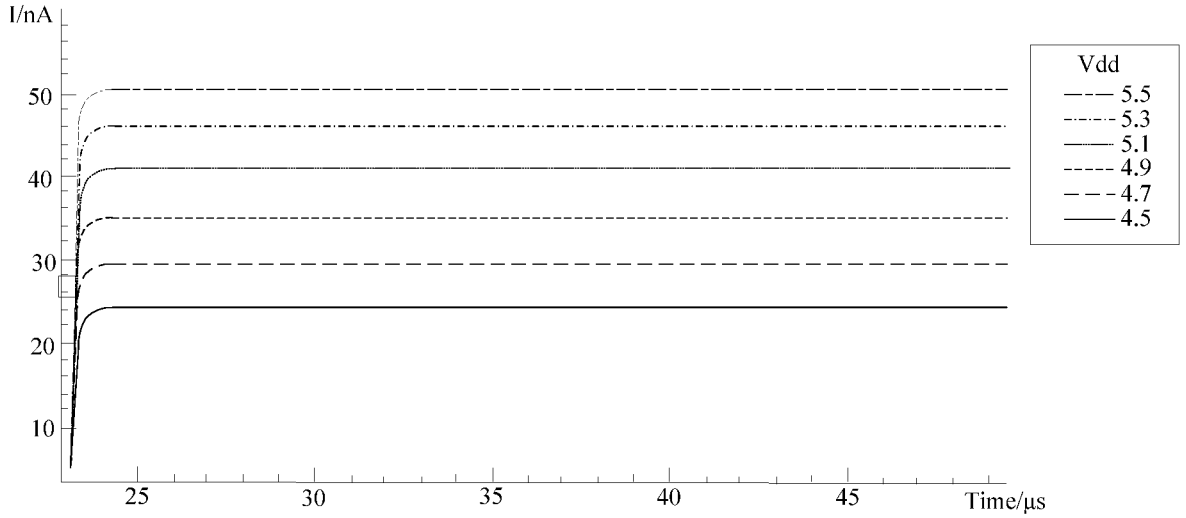
FIG. 6A and FIG. 6B are relationship diagrams of operating current of a light-emitting element in the pixel compensation circuit as illustrated in FIG. 3 and a high-level signal.
Figure 6B:
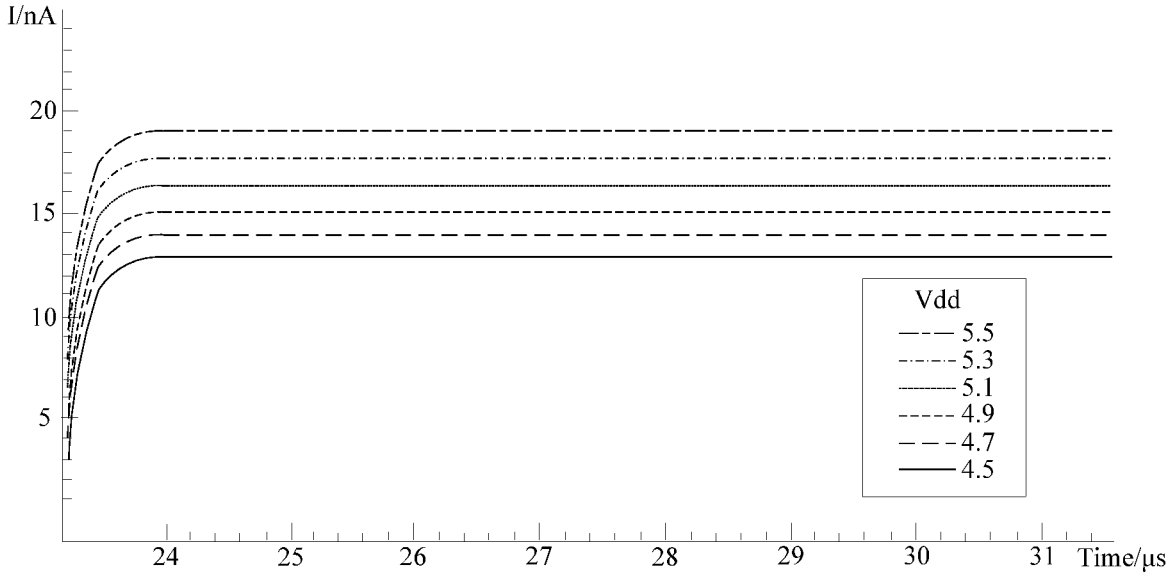

In order to better demonstrate the conclusion above, the disclosure provides relationship diagrams between the light-emission current of the light-emitting element OLED and the high-level signal Vdd output by the high-level power supply terminal VDD when the first capacitor C1 and the second capacitor C2 take different capacitances, as illustrated in FIG. 6A and FIG. 6B. Specifically both of the capacitances of the first capacitor C1 and the second capacitor C2 are 50 fF in FIG. 6A; and the capacitance of the first capacitor C1 is 80 fF, and the capacitance of the second capacitor C2 is 20 fF in FIG. 6B. As can be apparent from comparison between FIG. 6A and FIG. 6B, when the ratio of the capacitance of the first capacitor C1 to the capacitance of the second capacitor C2 is larger, the change of the IR drop of the high-level signal Vdd has less influence to the operating current of the light-emitting element OLED.

Furthermore as can be apparent from the two equations above, the operating current of the light-emitting element OLED is dependent upon both the data signal Vdata of the data signal terminal DATA, and the capacitances of the first capacitor C1 and the second capacitor C2, so the range of the data signal Vdata can be adjusted by setting the capacitances of the first capacitor C1 and the second capacitor C2 reasonably.

Figure 7A:
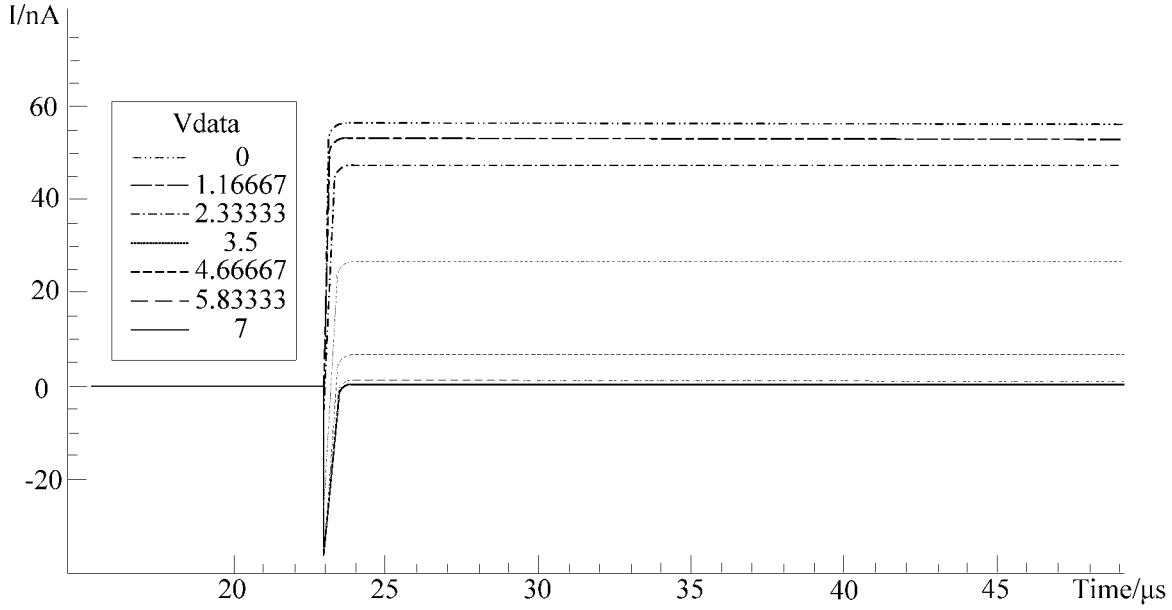
FIG. 7A and FIG. 7B are relationship diagrams of operating current of a light-emitting element in the pixel compensation circuit as illustrated in FIG. 3 and a data signal.
Figure 7B:
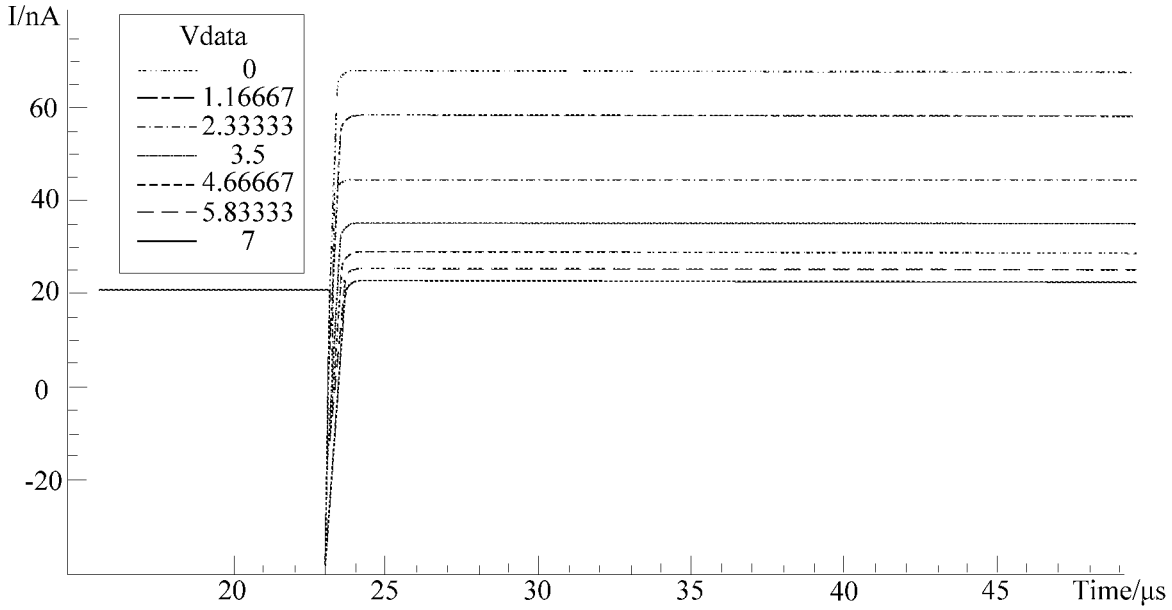

In order to better demonstrate the conclusion above, the disclosure provides relationship diagrams between the light-emission current of the light-emitting element OLED and the data signal Vdata when the first capacitor C1 and the second capacitor C2 take different capacitances, as illustrated in FIG. 7A and FIG. 7B. Specifically both of the capacitances of the first capacitor C1 and the second capacitor C2 are 50 fF in FIG. 7A; and the capacitance of the first capacitor C1 is 80 fF, and the capacitance of the second capacitor C2 is 20 fF in FIG. 7B. As can be apparent from comparison between FIG. 7A and FIG. 7B, when the ratio of the capacitance of the first capacitor C1 to the capacitance of the second capacitor C2 is larger, there is a wider range of the data signal Vdata thereof.

Figure 8:
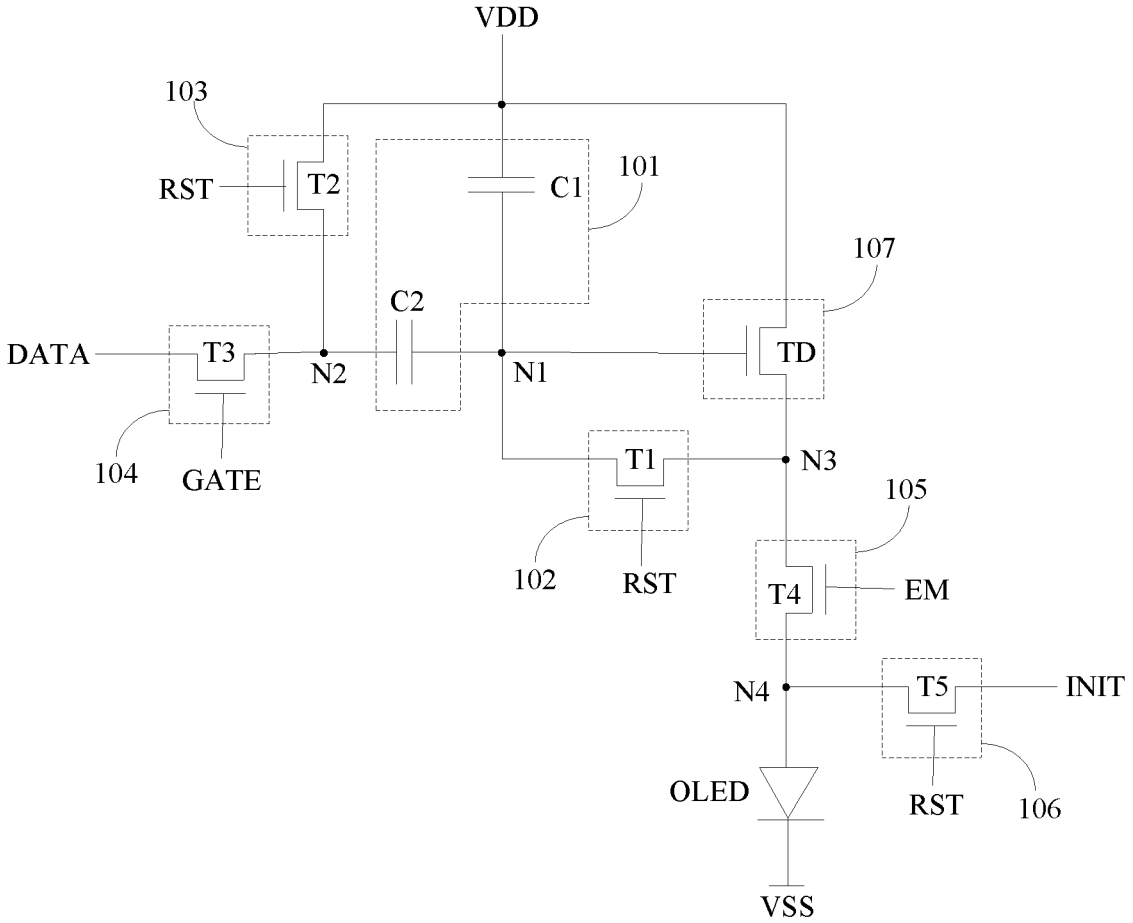
FIG. 8 is a second schematic diagram of a structure of the pixel compensation circuit as illustrated in FIG. 1.

FIG. 8 illustrates another embodiment of the pixel compensation circuit as illustrated in FIG. 1. Unlike the embodiment of the pixel compensation circuit as illustrated in FIG. 3, the respective transistors in the pixel compensation circuit as illustrated in FIG. 8 are N-type transistors which are turned on at a high level, and turned off at a low level, and the threshold voltage Vth of the driver transistor which is an N-type transistor is positive.

Figure 9:
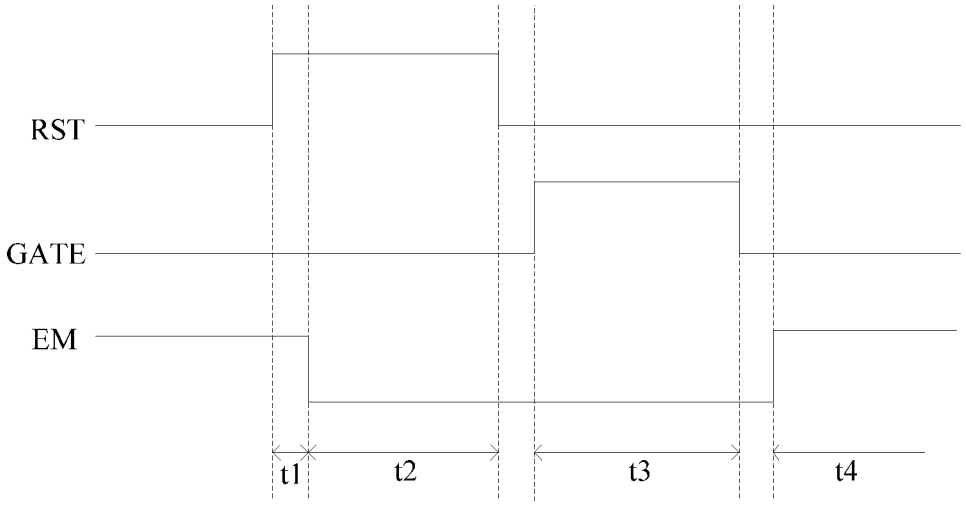
FIG. 9 is an operating timing diagram of the pixel compensation circuit as illustrated in FIG. 8.

Furthermore FIG. 9 illustrates an operating timing diagram of the pixel compensation circuit as illustrated in FIG. 8, and FIG. 10A to FIG. 10D illustrate operating states thereof in different periods. As can be apparent from comparison between FIG. 10A to FIG. 10D, and the respective operating states of the respective transistors in the pixel compensation circuit as illustrated in FIG. 3 in the different periods (i.e., FIG. 5A to FIG. 5D), the operating states of the pixel compensation circuit as illustrated in FIG. 10A to FIG. 10D are the same respectively as the operating states of the pixel compensation circuit as illustrated in FIG. 5A to FIG. 5D in the corresponding periods, so reference can be made to the description above of the operating states of the pixel compensation circuit as illustrated in FIG. 5A to FIG. 5D for a description of the operating states of the pixel compensation circuit as illustrated in FIG. 10A to FIG. 10D, and a repeated description thereof will be omitted here.

Figure 10A:
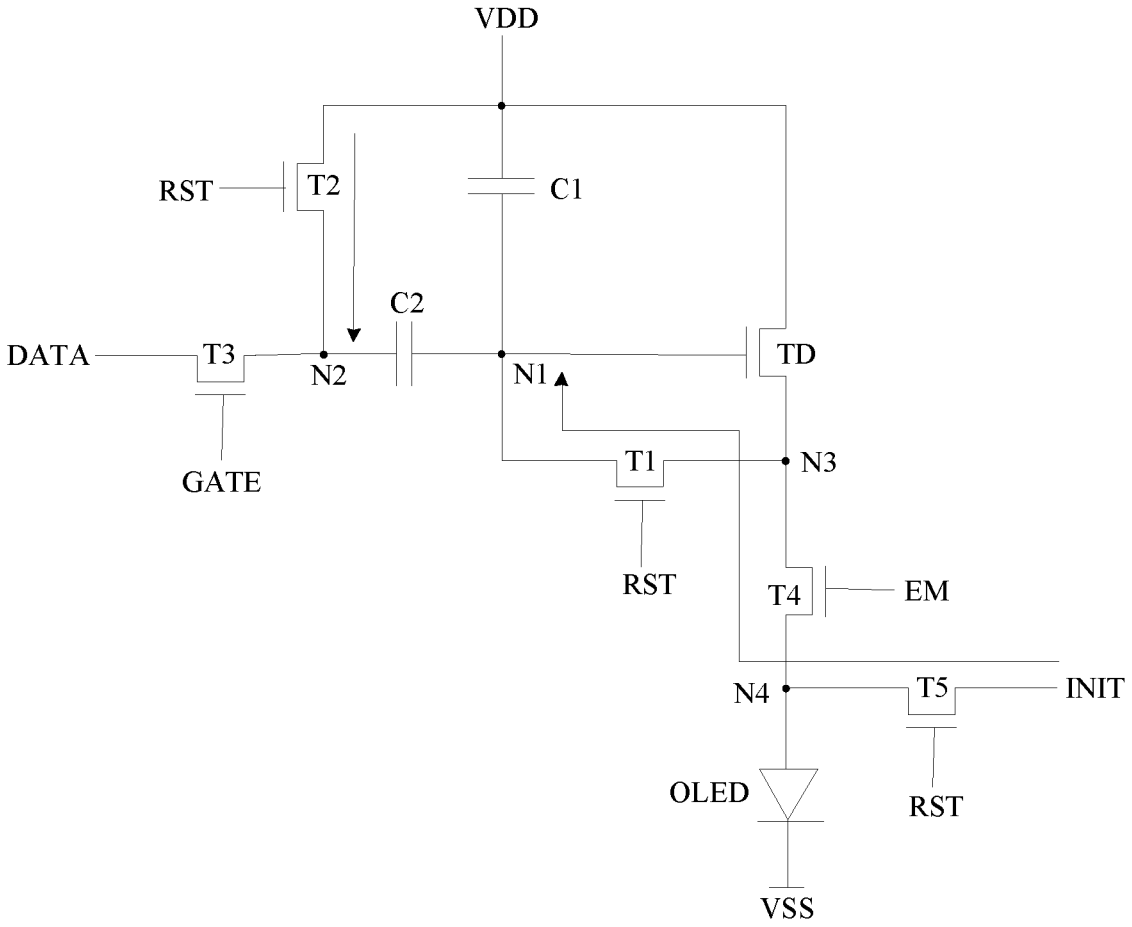
FIG. 10A to FIG. 10D are schematic diagrams of operating states of the pixel compensation circuit as illustrated in FIG. 8 in different periods.
Figure 10B:
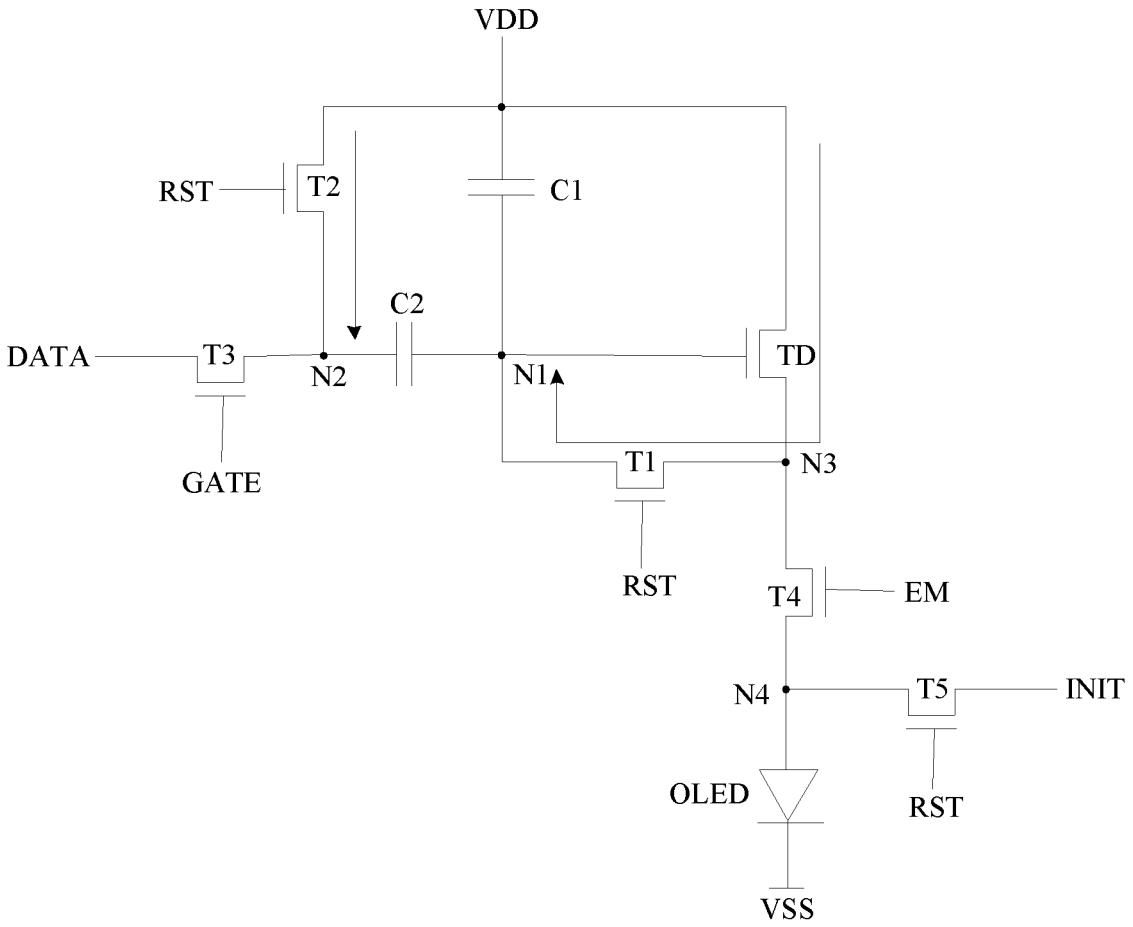
Figure 10C:
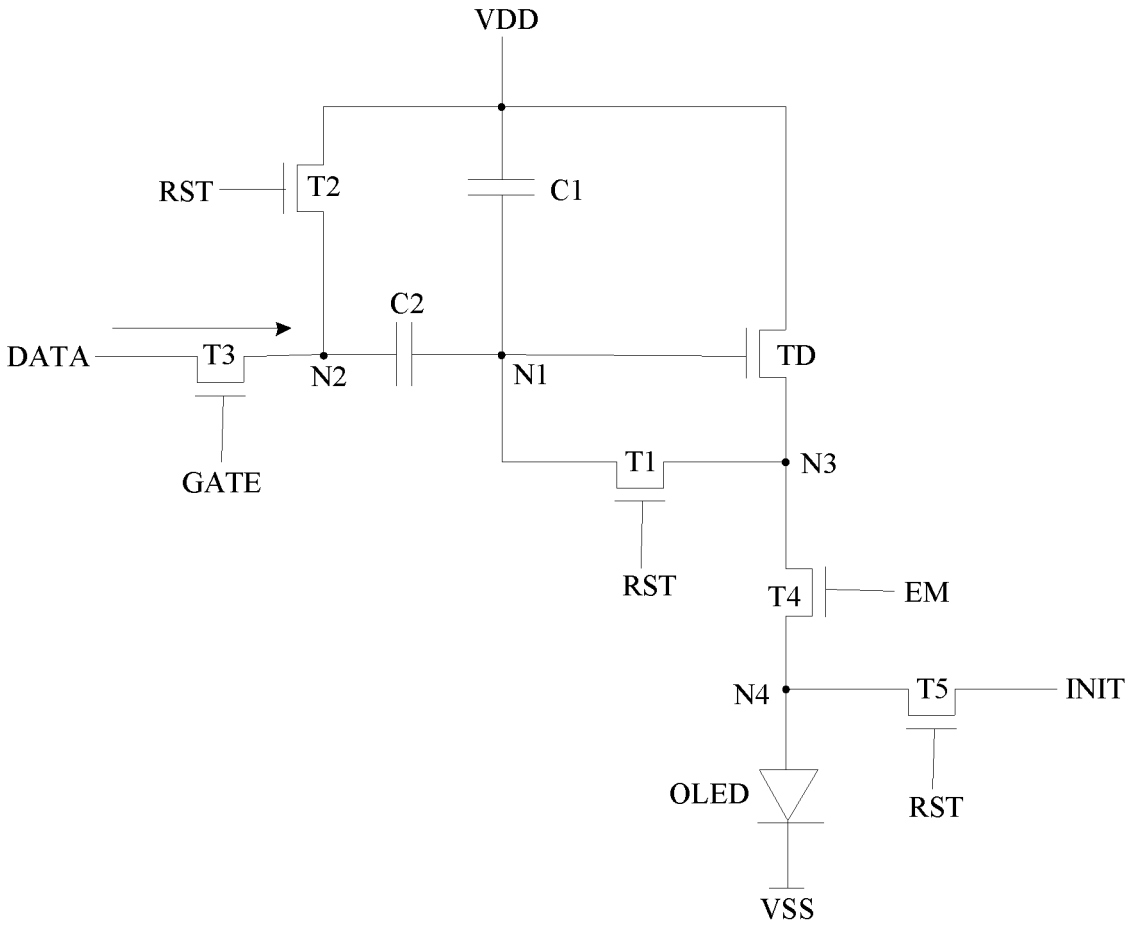
Figure 10D:
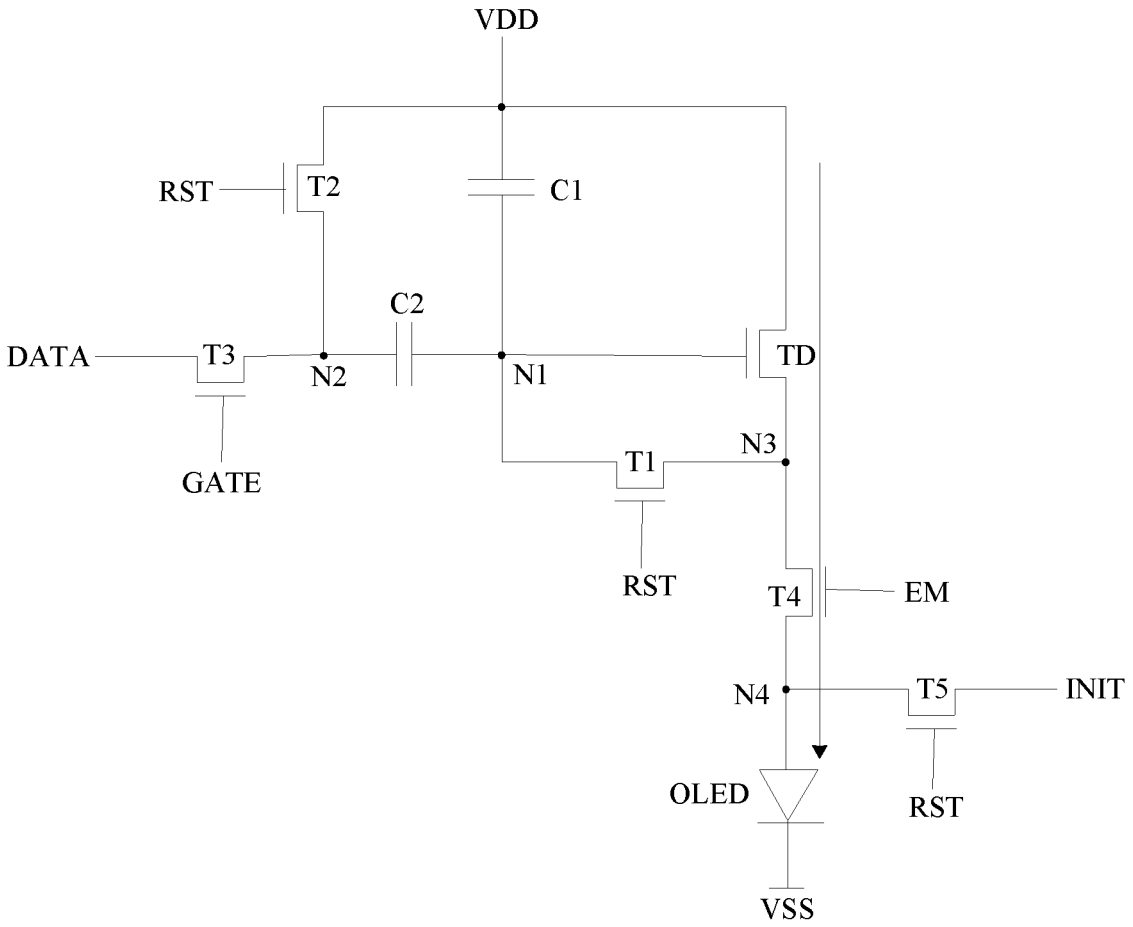

It shall be noted that unlike the first node N1 in the pixel compensation circuit as illustrated in FIG. 5B being charged to the voltage Vdd+Vth in the second period t2, the first node N1 in the pixel compensation circuit as illustrated in FIG. 10B being discharged to the voltage Vdd+Vth in the second period t2.

Based upon the same inventive idea, an embodiment of the disclosure provides a display panel including the pixel compensation circuit according to any one of the embodiments above of the disclosure. All the other components indispensable to the display panel shall readily occur to those ordinarily skilled in the art, so a repeated description thereof will be omitted here, and the disclosure will not be limited thereto. Since the display panel addresses the problem under a similar principle to the pixel compensation circuit above, reference can be made to the implementation of the pixel compensation circuit above according to the embodiment of the disclosure for an implementation of the display panel according to the embodiment of the disclosure, and a repeated description thereof will be omitted here.

Based upon the same inventive idea, an embodiment of the disclosure further provides a display device including the display panel above, and the display device can be a mobile phone, a tablet computer, a TV set, a displayer, a notebook computer, a digital camera, a navigator, a smart watch, a fitness wrist band, a personal digital assistant, an automatic teller machine, or any other product or component with a display function. All the other components indispensable to the display device shall readily occur to those ordinarily skilled in the art, so a repeated description thereof will be omitted here, and the disclosure will not be limited thereto. Reference can be made to the implementation of the display panel above according to the embodiment of the disclosure for an implementation of the display device according to the embodiment of the disclosure, and a repeated description thereof will be omitted here.

It shall be noted that in this context, the relationship terms, e.g., "first", "second", etc., are only intended to distinguish one entity or operation from another entity or operation, but not intended to require or suggest any such a real relationship or order between these entities or operations.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A pixel compensation circuit, comprising: a first initialization sub-circuit, a second initialization sub-circuit, an IR drop control sub-circuit, a data writing sub-circuit, a compensation sub-circuit, a driver sub-circuit, a light-emission control sub-circuit, and a light emitting element, wherein: the IR drop control sub-circuit is connected respectively with a first node, a second node, and a high-level power supply terminal, and configured to decrease an influence of an IR drop of a signal of the high-level power supply terminal to an operating current of the light emitting element; the compensation sub-circuit is connected respectively with a reset signal terminal, the first node, and the third node, and configured to write a threshold voltage of the driver sub-circuit and the signal of the high-level power supply terminal into the first node under the control of the reset signal terminal; the light-emission control sub-circuit is connected respectively with a light-emission control signal terminal, a third node and a fourth node, and the first initialization sub-circuit is connected respectively with the reset signal terminal, an initialization signal terminal, and the fourth node; the first initialization sub-circuit is configured, under the control of the reset signal terminal, to write a signal of the initialization signal terminal sequentially into the first node through the fourth node, the turned-on light-emission control sub-circuit, the third node and the compensation sub-circuit, and the first initialization sub-circuit is further configured, under the control of the reset signal terminal, to initialize the first node and the third node; the second initialization sub-circuit is connected respectively with the reset signal terminal, the high-level power supply terminal, and the second node, and configured to write the signal of the high-level power supply terminal into the second node under the control of the reset signal terminal; the data writing sub-circuit is connected respectively with a scan signal terminal, a data signal terminal, and the second node, and configured to write a signal of the data signal terminal into the second node under the control of the scan signal terminal; and the driver sub-circuit is connected respectively with the first node, the high-level power supply terminal, and the third node; the light emitting element has one terminal connected with the fourth node, and the other terminal connected with a low-level power supply terminal; and the driver sub-circuit is configured, under the control of the first node, to drive the light emitting element to emit light through the turned-on light-emission control sub-circuit.

2. The pixel compensation circuit according to claim 1, wherein the IR drop control sub-circuit comprises a first capacitor and a second capacitor, wherein the first capacitor has one terminal connected with the first node, and the other terminal connected with the high-level power supply terminal; and the second capacitor has one terminal connected with the first node, and the other terminal connected with the second node.

3. The pixel compensation circuit according to claim 1, wherein the compensation sub-circuit comprises a first switch transistor, and the first switch transistor has a gate connected with the reset signal terminal, a first electrode connected with the first node, and a second electrode connected with the third node.

4. The pixel compensation circuit according to claim 1, wherein the second initialization sub-circuit comprises a second switch transistor, and the second switch transistor has a gate connected with the reset signal terminal, a first electrode connected with the high-level power supply terminal, and a second electrode connected with the second node.

5. The pixel compensation circuit according to claim 1, wherein the data writing sub-circuit comprises a third switch transistor, and the third switch transistor has a gate connected with the scan signal terminal, a first electrode connected with the data signal terminal, and a second electrode connected with the second node.

6. The pixel compensation circuit according to claim 1, wherein the light-emission control sub-circuit comprises a fourth switch transistor, and the fourth switch transistor has a gate connected with the light-emission control terminal, a first electrode connected with the third node, and a second electrode connected with the fourth node.

7. The pixel compensation circuit according to claim 1, wherein the first initialization sub-circuit comprises a fifth switch transistor, and the fifth switch transistor has a gate connected with the reset signal terminal, a first electrode connected with the initialization signal terminal, and a second electrode connected with the fourth node.

8. The pixel compensation circuit according to claim 1, wherein the driver sub-circuit comprises a driver transistor, and the driver transistor has a gate connected with the first node, a first electrode connected with the high-level power supply terminal, and a second electrode connected with the third node.

9. The pixel compensation circuit according to claim 1, wherein the IR drop control sub-circuit comprises: a first capacitor and a second capacitor, wherein the first capacitor has one terminal connected with the first node, and the other terminal connected with the high-level power supply terminal; and the second capacitor has one terminal connected with the first node, and the other terminal connected with the second node;

the compensation sub-circuit comprises a first switch transistor, wherein the first switch transistor has a gate connected with the reset signal terminal, a first electrode connected with the first node, and a second electrode connected with the third node;

the second initialization sub-circuit comprises a second switch transistor, wherein the second switch transistor has a gate connected with the reset signal terminal, a first electrode connected with the high-level power supply terminal, and a second electrode connected with the second node;

the data writing sub-circuit comprises a third switch transistor, wherein the third switch transistor has a gate connected with the scan signal terminal, a first electrode connected with the data signal terminal, and a second electrode connected with the second node;

the light-emission control sub-circuit comprises a fourth switch transistor, wherein the fourth switch transistor has a gate connected with the light-emission control terminal, a first electrode connected with the third node, and a second electrode connected with the fourth node;

the first initialization sub-circuit comprises a fifth switch transistor, wherein the fifth switch transistor has a gate connected with the reset signal terminal, a first electrode connected with the initialization signal terminal, and a second electrode connected with the fourth node; and the driver sub-circuit comprises a driver transistor, wherein the driver transistor has a gate connected with the first node, a first electrode connected with the high-level power supply terminal, and a second electrode connected with the third node.

10. The pixel compensation circuit according to claim 2, wherein the other terminal, connected with the high-level power supply terminal, of the first capacitor is further connected with a terminal, connected with the high-level power supply terminal, of the second initialization sub-circuit, and the other terminal of the second capacitor is connected with the second initialization sub-circuit through the second node.

11. A method for driving a pixel compensation circuit, wherein the pixel compensation circuit comprises: a first initialization sub-circuit, a second initialization sub-circuit, an IR drop control sub-circuit, a data writing sub-circuit, a compensation sub-circuit, a driver sub-circuit, a light-emission control sub-circuit, and a light emitting element, wherein: the IR drop control sub-circuit is connected respectively with a first node, a second node, and a high-level power supply terminal, and configured to decrease an influence of an IR drop of a signal of the high-level power supply terminal to an operating current of the light emitting element; the compensation sub-circuit is connected respectively with a reset signal terminal, the first node, and the third node, and configured to write a threshold voltage of the driver sub-circuit and the signal of the high-level power supply terminal into the first node under the control of the reset signal terminal; the light-emission control sub-circuit is connected respectively with a light-emission control signal terminal, a third node and a fourth node, and the first initialization sub-circuit is connected respectively with the reset signal terminal, an initialization signal terminal, and the fourth node; the first initialization sub-circuit is configured, under the control of the reset signal terminal, to write a signal of the initialization signal terminal sequentially into the first node through the fourth node, the turned-on light-emission control sub-circuit, the third node and the compensation sub-circuit, and the first initialization sub-circuit is further configured, under the control of the reset signal terminal, to initialize the first node and the third node; the second initialization sub-circuit is connected respectively with the reset signal terminal, the high-level power supply terminal, and the second node, and configured to write the signal of the high-level power supply terminal into the second node under the control of the reset signal terminal; and the data writing sub-circuit is connected respectively with a scan signal terminal, a data signal terminal, and the second node, and configured to write a signal of the data signal terminal into the second node under the control of the scan signal terminal; and the driver sub-circuit is connected respectively with the first node, the high-level power supply terminal, and the third node; the light emitting element has one terminal connected with the fourth node, and the other terminal connected with a low-level power supply terminal; and the driver sub-circuit is configured, under the control of the first node, to drive the light emitting element to emit light through the turned-on light-emission control sub-circuit; and the method comprises: in a first period, enabling the first initialization sub-circuit, the second initialization sub-circuit, and the compensation sub-circuit respectively under the control of the reset signal terminal, and enabling the light-emission control sub-circuit under the control of the light-emission control signal terminal to enable the signal of the initialization signal terminal to be written into the first node, and the signal of the high-level power supply terminal to be written into the second node; in a second period, enabling the second initialization sub-circuit and the compensation sub-circuit respectively under the control of the reset signal terminal to enable the signal of the high-level power supply terminal to be written into the second node, and the threshold voltage of the driver sub-circuit and the signal of the high-level power supply terminal to be written into the first node; in a third period, enabling the data writing sub-circuit under the control of the scan signal terminal to enable the signal of the data writing sub-circuit to be written into the second node, and the IR drop control sub-circuit to decrease a change of the IR drop of the signal of the high-level power supply terminal; and in a fourth period, enabling the light-emission control sub-circuit under the control of the light-emission control signal terminal to enable the light emitting element to emit light.

12. A display panel, comprising a pixel compensation circuit, wherein the pixel compensation circuit comprises; a first initialization sub-circuit, a second initialization sub-circuit, an IR drop control sub-circuit, a data writing sub-circuit, a compensation sub-circuit, a driver sub-circuit, a light-emission control sub-circuit, and a light emitting element, wherein; the IR drop control sub-circuit is connected respectively with a first node, a second node, and a high-level power supply terminal, and configured to decrease an influence of an IR drop of a signal of the high-level power supply terminal to an operating current of the light emitting element; the compensation sub-circuit is connected respectively with a reset signal terminal, the first node, and the third node, and configured to write a threshold voltage of the driver sub-circuit and a signal of the high-level power supply terminal under the control of the reset signal terminal; the light-emission control sub-circuit is connected respectively with a light-emission control signal terminal, a third node and a fourth node, and the first initialization sub-circuit is connected respectively with the reset signal terminal, an initialization signal terminal, and the fourth node; the first initialization sub-circuit is configured, under the control of the reset signal terminal, to write a signal of the initialization signal terminal sequentially into the first node through the fourth node, the turned-on light-emission control sub-circuit, the third node, and the compensation sub-circuit, and the first initialization sub-circuit is further configured, under the control of the reset signal terminal, to initialize the first node and the third node; the second initialization sub-circuit is connected respectively with the reset signal terminal, the high-level power supply terminal, and the second node, and configured to write the signal of the high-level power supply terminal into the second node under the control of the reset signal terminal; the data writing sub-circuit is connected respectively with a scan signal terminal, a data signal terminal, and the second node, and configured to write a signal of the data signal terminal into the second node under the control of the scan signal terminal; and the driver sub-circuit is connected respectively with the first node, the high-level power supply terminal, and the third node; the light emitting element has one terminal connected with the fourth node, and the other terminal connected with a low-level power supply terminal; and the driver sub-circuit is configured, under the control of the first node, to drive the light emitting element to emit light through the turned-on light-emission control sub-circuit.

13. The display panel according to claim 12, wherein the IR drop control sub-circuit comprises a first capacitor and a second capacitor, wherein the first capacitor has one terminal connected with the first node, and the other terminal connected with the high-level power supply terminal; and the second capacitor has one terminal connected with the first node, and the other terminal connected with the second node.

14. The display panel according to claim 12, wherein the compensation sub-circuit comprises a first switch transistor, and the first switch transistor has a gate connected with the reset signal terminal, a first electrode connected with the first node, and a second electrode connected with the third node.

15. The display panel according to claim 12, wherein the second initialization sub-circuit comprises a second switch transistor, and the second switch transistor has a gate connected with the reset signal terminal, a first electrode connected with the high-level power supply terminal, and a second electrode connected with the second node.

16. The display panel according to claim 12, wherein the data writing sub-circuit comprises a third switch transistor, and the third switch transistor has a gate connected with the scan signal terminal, a first electrode connected with the data signal terminal, and a second electrode connected with the second node.

17. The display panel according to claim 12, wherein the light-emission control sub-circuit comprises a fourth switch transistor, and the fourth switch transistor has a gate connected with the light-emission control terminal, a first electrode connected with the third node, and a second electrode connected with the fourth node.

18. The display panel according to claim 12, wherein the first initialization sub-circuit comprises a fifth switch transistor, and the fifth switch transistor has a gate connected with the reset signal terminal, a first electrode connected with the initialization signal terminal, and a second electrode connected with the fourth node.

19. The display panel according to claim 12, wherein the driver sub-circuit comprises a driver transistor, and the driver transistor has a gate connected with the first node, a first electrode connected with the high-level power supply terminal, and a second electrode connected with the third node.

20. A display device, comprising the display panel according to claim 12.

* * * * *